US010662790B2

(12) United States Patent
Lee

(10) Patent No.: US 10,662,790 B2
(45) Date of Patent: May 26, 2020

(54) VANE ASSEMBLY AND GAS TURBINE INCLUDING THE SAME

(71) Applicant: DOOSAN HEAVY INDUSTRIES & CONSTRUCTION CO., LTD., Changwon-si, Gyeongsangnam-do (KR)

(72) Inventor: Hye Ri Lee, Seogwipo-si (KR)

(73) Assignee: Doosan Heavy Industries Co., Ltd., Gyeongsangnam-do (KR)

( * ) Notice: Subject to any disclaimer, the term of this patent is extended or adjusted under 35 U.S.C. 154(b) by 116 days.

(21) Appl. No.: 15/954,608

(22) Filed: Apr. 17, 2018

(65) Prior Publication Data

US 2018/0340433 A1 Nov. 29, 2018

(30) Foreign Application Priority Data

May 24, 2017 (KR) ..... 10-2017-0064037

(51) Int. Cl.
*F01D 9/04* (2006.01)

(52) U.S. Cl.
CPC ..... *F01D 9/042* (2013.01); *F01D 9/04* (2013.01); *F05D 2220/32* (2013.01); *F05D 2230/60* (2013.01); *F05D 2230/64* (2013.01); *F05D 2240/10* (2013.01); *F05D 2240/12* (2013.01); *F05D 2250/131* (2013.01); *F05D 2250/14* (2013.01)

(58) Field of Classification Search
CPC ..... F01D 9/04; F01D 9/042; F05D 2220/32; F05D 2230/60; F05D 2230/64; F05D 2240/10; F05D 2240/12; F05D 2250/131; F05D 2250/14
See application file for complete search history.

(56) References Cited

U.S. PATENT DOCUMENTS 3,326,523 A * 6/1967 Bobo ..... F01D 9/042 415/209.3
3,339,833 A * 9/1967 Bill ..... F01D 9/042 416/219 R
3,393,436 A * 7/1968 Blackhurst ..... F01D 9/044 29/889.22
3,997,280 A * 12/1976 Germain ..... F01D 9/042 415/189
5,022,818 A * 6/1991 Scalzo ..... F04D 29/542 415/209.3
5,494,404 A * 2/1996 Furseth ..... F01D 9/042 415/209.3

(Continued)

FOREIGN PATENT DOCUMENTS

DE 102009003714 A1 10/2009
EP 1978212 A2 10/2008

(Continued)

OTHER PUBLICATIONS

An European Search Report dated Oct. 17, 2018 in connection with European Patent Application No. 18169443.1.

*Primary Examiner* — Igor Kershteyn
(74) *Attorney, Agent, or Firm* — Invenstone Patent, LLC

(57) ABSTRACT

Disclosed is a vane assembly. An outer ring segment surrounds a rotor extending through an inner central portion of a casing. Vanes are fitted into the outer ring segment in a direction perpendicular to an axial direction of the rotor. A fixing portion is fitted into the outer ring segment to fix the vanes to the outer ring segment.

16 Claims, 12 Drawing Sheets

(56) References Cited

U.S. PATENT DOCUMENTS

| | | | | |
|---|---|---|---|---|
| 5,860,787 | A * | 1/1999 | Richards | F01D 5/326<br>416/220 R |
| 7,661,924 | B2 * | 2/2010 | Wassynger | F01D 5/3007<br>415/137 |
| 8,459,944 | B2 * | 6/2013 | Hamana | F01D 9/041<br>415/210.1 |
| 2009/0252610 | A1 * | 10/2009 | Wassynger | F01D 9/042<br>416/220 R |

FOREIGN PATENT DOCUMENTS

| | | | |
|---|---|---|---|
| GB | 2313162 | A | 11/1997 |
| KR | 10-1513061 | B1 | 4/2015 |
| KR | 10-1689085 | B1 | 1/2017 |

* cited by examiner

VANE ASSEMBLY AND GAS TURBINE INCLUDING THE SAME

CROSS-REFERENCE TO RELATED APPLICATION

This application claims priority to Korean Patent Application No. 10-2017-0064037, filed on May 24, 2017, the disclosure of which is incorporated herein by reference in its entirety.

BACKGROUND OF THE DISCLOSURE

Field of the Disclosure

The present disclosure relates, in general, to a vane assembly, and more particularly, to the vane assembly, a gas turbine including the vane assembly, and a method of assembling the vane assembly of the gas turbine.

Description of the Related Art

A turbine is a mechanical device that produces torque due to impulse or reactive force using a flow of compressive fluid, such as steam or gas. The turbines may be categorized as a steam turbine using steam, a gas turbine using hot combustion gas, or the like.

The gas turbine generally includes a compressor, a combustor, and a turbine. The compressor has an air inlet, through which air is introduced. A plurality of compressor vanes and a plurality of blades are alternatingly disposed within a compressor casing.

The combustor generates a high-temperature and high-pressure combustion gas by supplying fuel to air compressed by the compressor and igniting the gas mixture using a burner.

The turbine includes a plurality of vanes and a plurality of turbine blades alternatingly disposed within a turbine casing. In addition, a rotor is disposed to extend through the central portions of the compressor, the combustor, the turbine, and an exhaust chamber.

Both ends of the rotor are rotatably supported by bearings. A plurality of disks are fixed to the rotor to connect blades, and a driving shaft, such as a generator, is connected to one end on the exhaust chamber side.

The gas turbine does not have portions rubbing against each other, such as a piston and a cylinder, since a reciprocating mechanism, such as the piston, of a four-stroke engine is not used. Accordingly, the gas turbine has the following advantages: the consumption of lubricant is extremely low, the amplitude, which is the characteristic of the reciprocating mechanism, is significantly reduced, and high-speed movement is possible.

Air compressed in the compressor is mixed with fuel before combustion to produce the high-temperature combustion gas, which is then injected toward the turbine. The injected combustion gas generates torque while passing through the turbine vanes and the turbine blades, thereby rotating the rotor.

SUMMARY OF THE DISCLOSURE

Accordingly, the present disclosure proposes a vane assembly configured to be easily assembled and fixed and a gas turbine including a plurality of such vane assemblies.

In order to achieve the above objective, according to one aspect of the present disclosure, a vane assembly may include an outer ring segment surrounding a rotor extending through an inner central portion of a casing, vanes fitted into the outer ring segment in a direction perpendicular to an axial direction of the rotor, and a fixing portion fitted into the outer ring segment to fix the vanes to the outer ring segment.

The outer ring segment may include first fitting cavities respectively extending in the axial direction of the rotor and second fitting cavities provided within the outer ring segment to be arranged in a circumferential direction of the outer ring segment. The vanes may be fitted into the first fitting cavities, and the fixing portion may be fitted into the second fitting cavities. The second fitting cavities may perpendicularly intersect the first fitting cavities. The outer ring segment may include an arc-shaped outer ring segment extending a predetermined length.

The first fitting cavities may have a shape selected from the group consisting of a polygon, an ellipse, and a rounded shape, directed radially outward of the rotor or the outer ring segment.

The outer ring segment may further include a plurality of protrusions provided in the first fitting cavities to protrude in the axial direction of the rotor.

A pair of protrusions among the plurality of protrusions may be provided on both sides of a corresponding fitting cavity among the plurality of fitting cavities to face each other in the circumferential direction of the outer ring segment.

The vanes may include roots fitted into the first fitting cavities, the roots having a shape conforming to a shape of the first fitting cavities.

The roots may include vane protrusions protruding toward the first fitting cavities.

The vanes may further include vane recesses provided in the roots such that the fixing portion is fitted into the vane recesses, the vane recesses having a cross-section corresponding to a cross-section of the fixing portion. A length of the fixing portion may be shorter than a length of the outer ring segment.

The vane assembly may include an outer ring segment surrounding a rotor extending through an inner central portion of a casing provided in a compressor of the gas turbine, the outer ring segment including first fitting cavities respectively extending in an axial direction of the rotor and second fitting cavities provided within the outer ring segment to be arranged in a circumferential direction of the outer ring segment, vanes fitted into the first fitting cavities, and a fixing portion fitted into the second fixing cavities to fix the vanes to the outer ring segment.

The fixing portion may have a curvature the same as a curvature of the outer ring segment. Alternatively, the fixing portion may have a curvature the same as but a different length from the outer ring segment.

The fixing portion may include: a lug protruding outwards from a leading end of the fixing portion, in a direction in which the fixing portion is inserted into the second fitting cavities of the outer ring segment; and a receptacle recessed into a rear end of the fixing portion.

The vanes may include roots fitted into the first fitting cavities, the roots having a shape conforming to a shape of the first fitting cavities.

The vanes may further include vane recesses provided in the roots such that the fixing portion is fitted into the vane recesses, the vane recesses having a cross-section corresponding to a cross-section of the fixing portion.

The vane recesses may be concentric with the rotor and be curved with a curvature corresponding to a segment of the outer ring segment.

The roots may include vane protrusions protruding toward the first fitting cavities.

The second fitting cavities of the outer ring segment may perpendicularly intersect the first fitting cavities of the outer ring segment.

The first fitting cavities may have a shape selected from the group consisting of a polygon, an ellipse, and a rounded shape, directed radially outward of the rotor or the outer ring segment.

The outer ring segment may further include a plurality of protrusions provided in the first fitting cavities to protrude in the axial direction of the rotor.

A pair of protrusions among the plurality of protrusions may be provided on both sides of a corresponding fitting cavity among the plurality of fitting cavities to face each other in the circumferential direction of the outer ring segment.

The protrusions may be located in regions except for a path along which the fixing portion is inserted.

According to embodiments of the present disclosure, when a plurality of vanes of a vane assembly is coupled to an outer ring segment, the vanes can be easily fixed using a fixing portion, thereby improving workability and fixing force.

According to embodiments of the present disclosure, vane assemblies disposed in a compressor of a gas turbine can be efficiently fixed, and fixing portions can be thermally expanded depending on temperatures, thereby further improving fixing force.

BRIEF DESCRIPTION OF THE DRAWINGS

The above and other objects, features and advantages of the present disclosure will be more clearly understood from the following detailed description when taken in conjunction with the accompanying drawings, in which.

DETAILED DESCRIPTION OF THE DISCLOSURE

Prior to the description of an exemplary embodiment of the present disclosure, a basic configuration of a gas turbine according to the present disclosure will be described with reference to the drawings.

Figure 1:
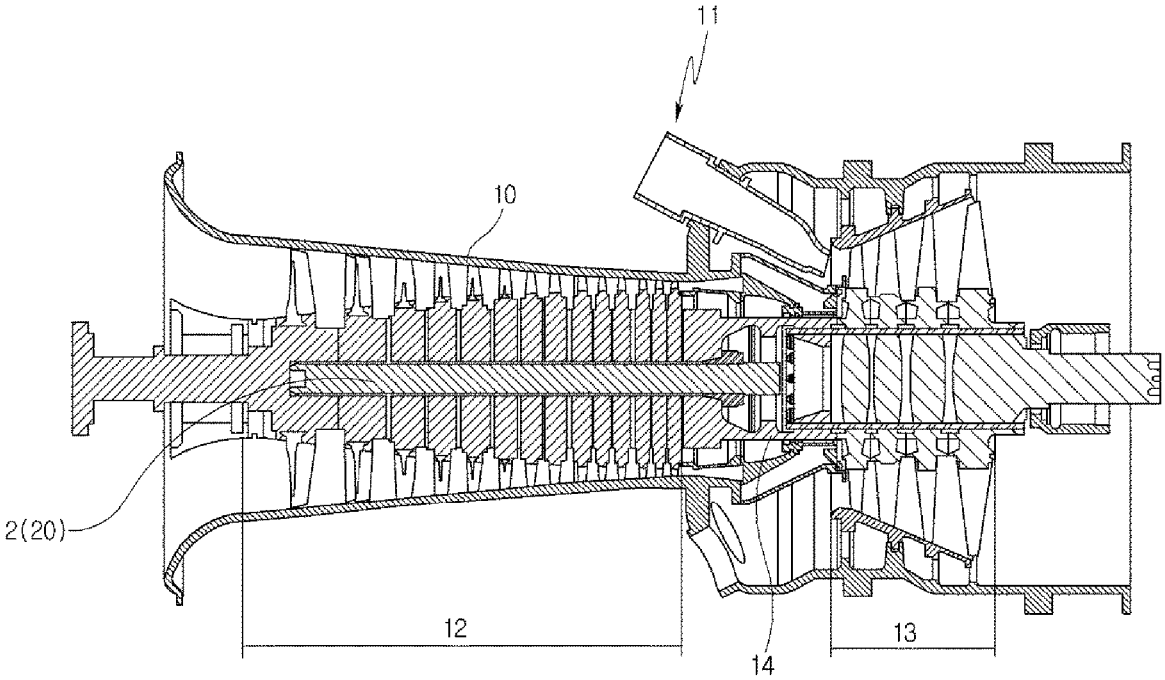
FIG. 1 is a cross-sectional view illustrating a gas turbine according to an embodiment of the present disclosure.

Referring to FIG. 1, a gas turbine includes a casing 10 forming an outer cover and a diffuser disposed at the rear of the casing 10. An exhaust gas that has passed through a turbine 13 is discharged through the diffuser. In addition, a combustor 11 is disposed in front of the diffuser to receive and burn a compressed gas.

With respect to the direction of air current, a compressor 12 is located upstream of the casing 10, while the turbine 13 is located downstream of the casing 10. In addition, a torque tube 14 is provided between the compressor 12 and the turbine 13 as a torque transmission member to transmit rotational torque, generated by the turbine, to the compressor 12.

The compressor 12 is provided with a plurality of (e.g. fourteen) compressor rotor disks, which are fastened by a rotor 2 (20) so as not to be spaced apart in the axial direction.

The compressor rotor disks and the rotor 2 (20) are aligned along the axial direction, with the rotor 2 (20) extending through the central portions of the compressor rotor disks. A flange axially protrudes from each of the compressor rotor disks and is non-rotatably coupled to an adjacent compressor rotor disk.

Multiple blades are radially coupled to the outer circumferential surfaces of the compressor rotor disks. Each of the blades is fastened to the compressor rotor disk by a dovetail joint.

The dovetail joint may be a tangential type joint or an axial type joint, which may be selected depending on the required structures of commercially-available gas turbines. In some cases, the blade may be fastened to the compressor rotor disk using another fastening device type.

The rotor 2 (20) is disposed to extend through the central portions of the plurality of compressor rotor disks. One end of the rotor 2 (20) is fastened to the interior of a compressor rotor disk, among the plurality of compressor rotor disks, located most upstream, while the other end of the rotor 2 (20) is fixed to the torque tube 14.

The configuration of the rotor 2 (20) is not limited to the configuration illustrated in FIG. 1 since the rotor 2 (20) may be one of a variety of structures.

The rotor 2 (20) may be configured such that a single rotor 2 (20) extends through the central portions of the rotor disks or may be modified into another configuration.

Although not shown in the drawings, the compressor of the gas turbine may be provided with vanes acting as guide guides in positions after the diffuser to adjust the flow angle of fluid entering a combustor inlet to be the same as a designed flow angle after the pressure of the fluid is raised. These vanes form a structure referred to as a deswirler.

The combustor 11 produces a high-temperature and high-pressure combustion gas having high energy by mixing introduced compressed air with fuel and combusting the gas mixture, and by isothermal combustion, raises the temperature of the combustion gas to a heat-resistance limit that the combustor and turbine components can resist.

A plurality of combustors, which provide components of a combustion system of the gas turbine, may be disposed within the cell-shaped casing. Each of the combustors includes a burner including a fuel injection nozzle or the like, a combustor liner defining a combustion chamber, and a transition piece forming a joint between the combustor and the turbine.

Specifically, the liner provides a combustion space in which fuel injected by a fuel nozzle is mixed with compressed air and is then combusted. The liner may include a flame tube defining the combustion space in which fuel mixed with air is combusted and a flow sleeve defining an annular space while surrounding the flame tube. The fuel nozzle is coupled to the front end of the liner, and an ignition plug is coupled to a side wall of the liner.

The transition piece is connected to the rear end of the liner to direct a combustion gas combusted by the ignition plug toward the turbine. The outer wall of the transition piece is cooled by the compressed air supplied by the compressor so as not to be damaged by high-temperature heat of the combustion gas.

In this regard, the transition piece has cooling holes which allows air to be injected into the transition piece. Compressed air is introduced through the cooling holes to cool the body within the transition piece, and then flows toward the liner.

Cooling air that has cooled the transition piece may flow in the annular space of the liner. In addition, the compressed air may be supplied as cooling air from outside of the flow sleeve through cooling holes in the flow sleeve to collide against the outer wall of the liner.

In general, in the turbine, high-temperature and high-pressure combustion gas supplied by the combustor expands to apply impulsive and/or reactive force to rotatable blades of the turbine, thereby generating mechanical energy. A portion of the mechanical energy produced by the turbine is supplied as energy necessary for compressing air in the compressor, while the remaining portion of the mechanical energy is used to drive a generator to generate electric power.

The turbine has a plurality of stator blades and a plurality of rotor blades alternatingly disposed within a casing, and the turbine drives the rotor blades using combustion gas to rotate an output shaft to which the generator is connected.

In this regard, the turbine 13 is provided with a plurality of turbine rotor disks. The shape of the turbine rotor disks is generally similar to the shape of the compressor rotor disks.

Accordingly, the turbine rotor disks respectively include a flange, by which adjacent turbine rotor disks are coupled to each other, as well as a plurality of radially-disposed turbine blades. The plurality of turbine blades may also be coupled to the turbine rotor disks using a dovetail joint.

In the gas turbine having the above-described structure, air is introduced and compressed in the compressor 12 and is directed to the combustor 11 to be used for combustion. Subsequently, the combustion gas is directed to the turbine 13 to drive the turbine and is discharged to the air through the diffuser.

The present disclosure having the above-described configuration may be applied to a variety of configurations including a rotor. For example, the present disclosure is applicable to a rotor of a turbine or a power plant. Such an application will be described with reference to the drawings.

Referring to FIGS. 1 to 5, according to the present embodiment, a plurality of vanes 200 are disposed to be concentric with the rotor 2, as illustrated in the drawings, and high-pressure fluid moves in the axial direction of the rotor 2 by passing through the vanes 200.

Figure 2:
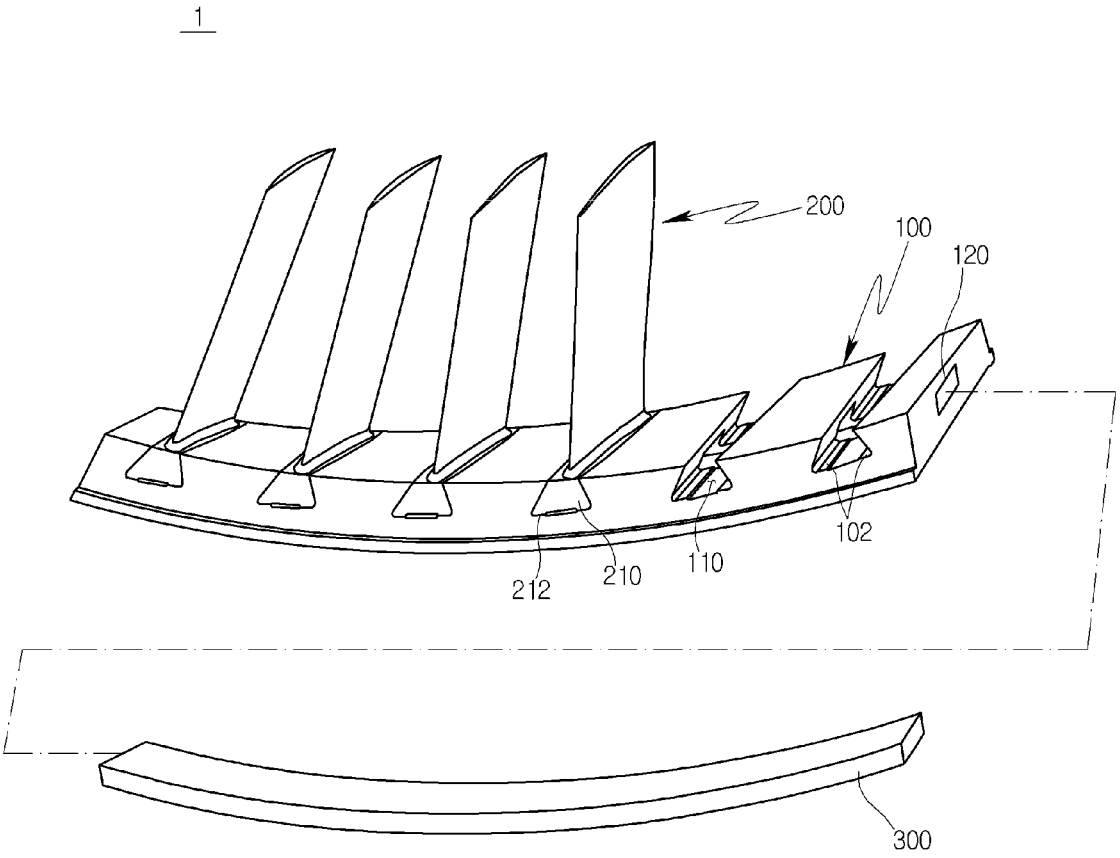
FIGS. 2 and 3 are perspective views illustrating a vane assembly according to an embodiment of the present disclosure.
Figure 3:
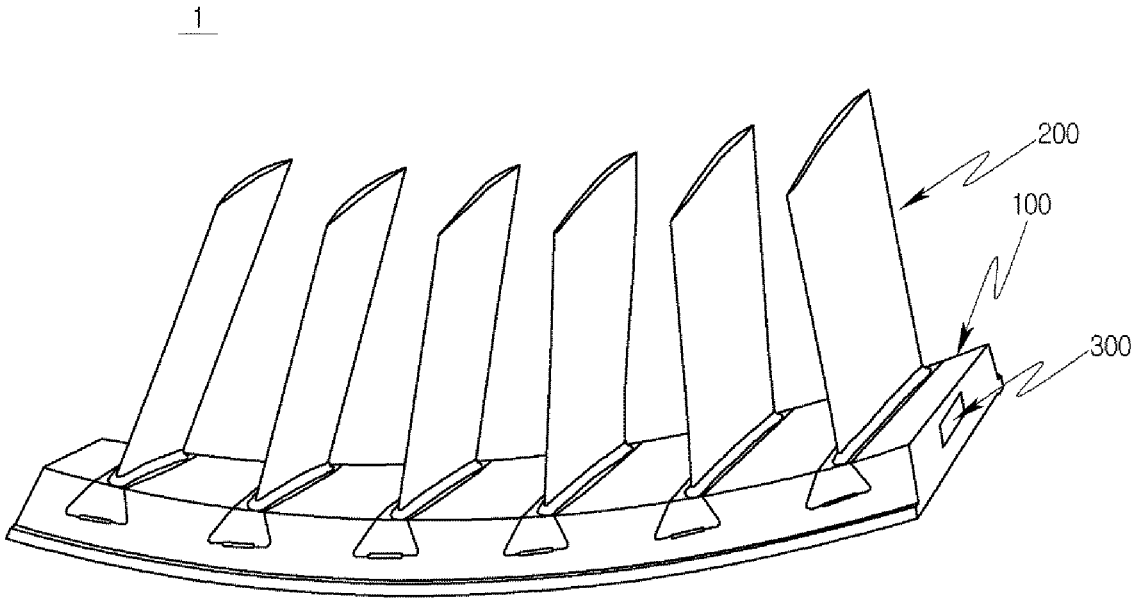
Figure 4:
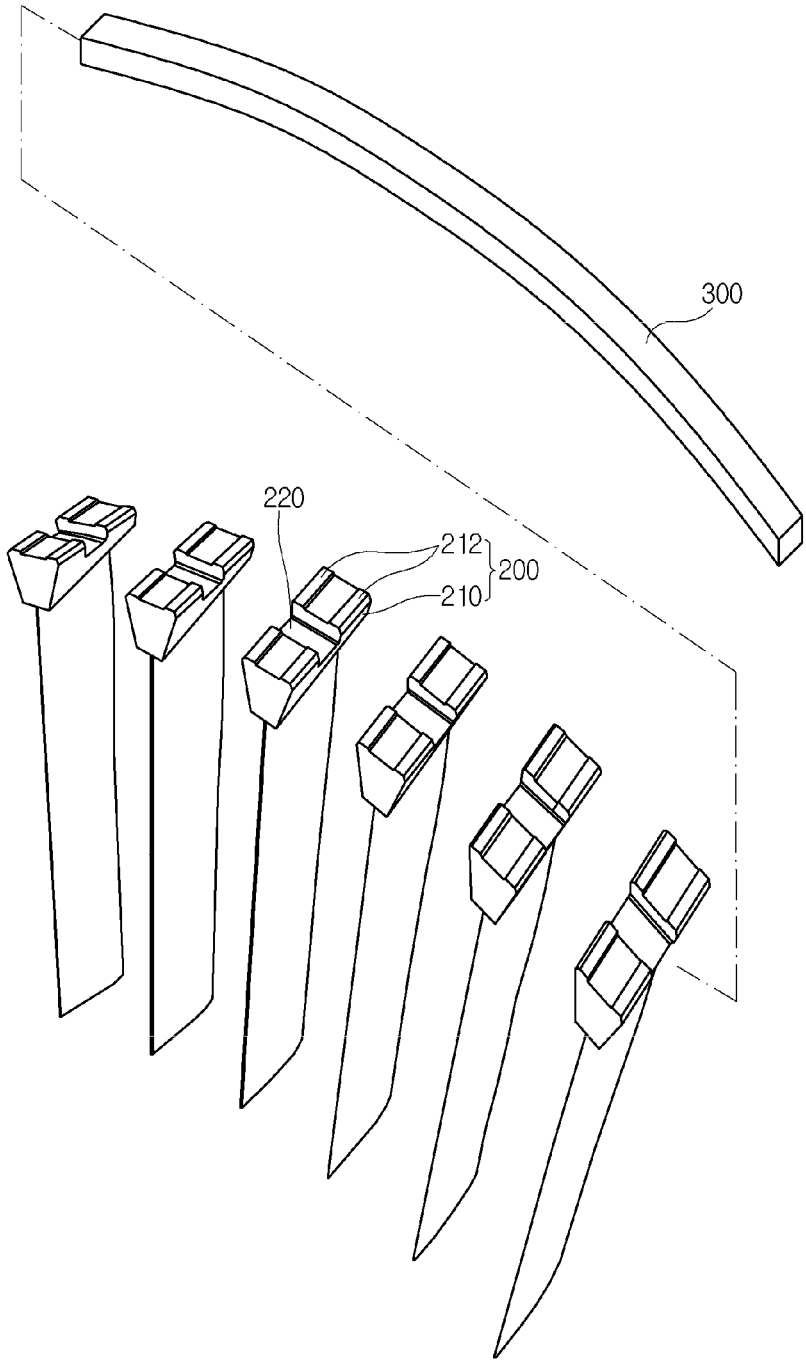
FIGS. 4 and 5 are perspective views illustrating the coupling of the vanes and the fixing portion of the vane assembly according to an embodiment of the present disclosure.
Figure 5:
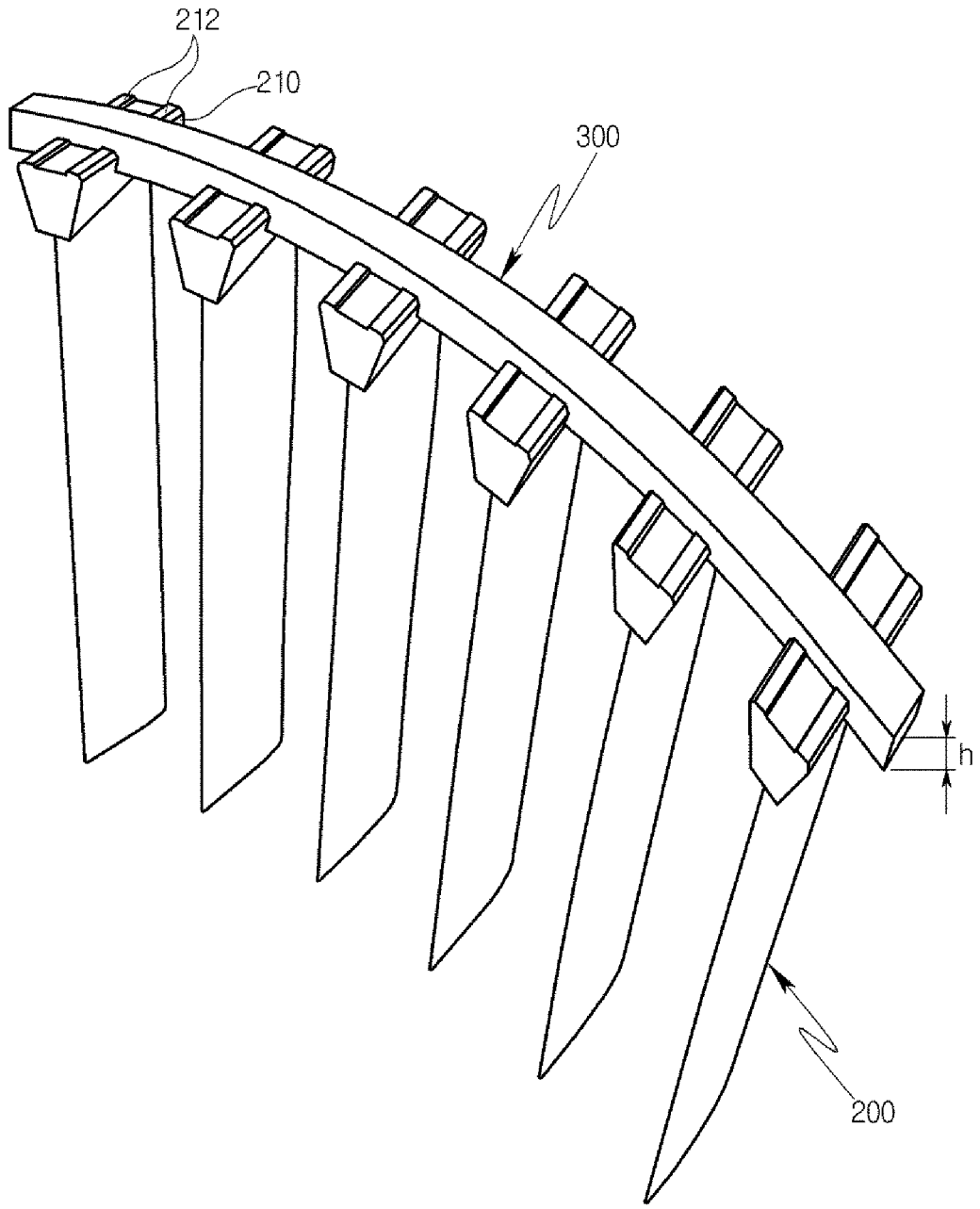

The vanes 200 guide the flow of fluid such that the fluid that has passed through the vanes 200 continuously flows in the axial direction of the rotor 2. FIGS. 2 and 3 are perspective views illustrating a vane assembly according to an embodiment of the present disclosure, and FIGS. 4 and 5 are perspective views illustrating the coupling of the vanes and the fixing portion of the vane assembly according to an embodiment of the present disclosure.

The vane assembly according to the present embodiment includes an outer ring segment 100 surrounding the rotor 2 extending through the inner central portion of the casing 10, a plurality of vanes 200 fitted into the outer ring segment 100 in directions perpendicular to the axial direction of the rotor 2, and a fixing portion 300 fitted into the outer ring segment 100 to fix the vanes 200 to the outer ring segment 100.

The outer ring segment 100 has the shape of an arc extending a predetermined length, and a plurality of outer ring segments 100 are in tight contact with each other in the circumferential direction, thereby forming a single outer ring. The outer ring segment 100 has first fitting cavities 110 and second fitting cavities 120. The first fitting cavities 110 extend in the axial direction of the rotor 2, such that the vanes 200 are fitted thereinto. The second fitting cavities 120 are provided in inner portions of the outer ring segment 100 in the circumferential direction of the outer ring segment 100.

The shape of the first fitting cavities 110 is one selected from among a polygon, an ellipse, or a rounded shape, directed radially outward of the rotor 2 or the outer ring segment 100. According to the present embodiment, the first fitting cavities 110 are illustrated as a triangular shape since the vanes 200 are fitted into the first fitting cavities 110. However, the shape of the first fitting cavities 110 is not limited thereto but may be altered to other shapes.

In particular, when the first fitting cavities 110 are of a triangular shape, the vanes 200 can firmly remain in the fitted positions without being radially separated.

The first fitting cavities 110 are disposed in the outer ring segment 100 to be spaced apart from each other at equal distances in the circumferential direction. The vanes 200 fitted into the first fitting cavities 110 are disposed on the inner circumferential portions of the outer ring segment 100, where the vanes 200 are spaced apart from each other at equal distances.

When the vanes 200 to be described later are fitted into the first fitting cavities 110, the vanes 200 come into tight contact with the first fitting cavities 110, thereby firmly disposed in the fitted positions.

According to the present embodiment, the first fitting cavities 110 of the outer ring segment 100 perpendicularly intersect the second fitting cavities 120. Since the fixing portion 300 is inserted into the second fitting cavities 120 via open portions of the first fitting cavities 110, the vanes 200 can be firmly fixed.

The outer ring segment 100 further includes a plurality of grooves 102 provided in the first fitting cavities 110 to extend in the axial direction of the rotor 20. A pair of grooves 102 is provided on both sides of each of the first fitting cavities 110 to face each other in the circumferential direction of the outer ring segment 100. When the vanes 200 are fitted into the first fitting cavities 110, the grooves 102 guide the vanes 200 to facilitate the insertion thereof.

Since the grooves 102 are disposed in regions of the first fitting cavities 110, except for a path along which the fixing portion 300 is inserted, the vanes 200 can be firmly fixed to the outer ring segment 100.

Each of the vanes 200 includes a root 210 fitted into a first fitting cavity, among the first fitting cavities 110, corresponding thereto. The shape of the root 210 conforms to the shape of the first fitting cavities 110.

The root 210 has vane protrusions 212 protruding toward the corresponding one of the first fitting cavities 110. The vane protrusions 212 are provided in positions corresponding to the above-described grooves 102, with their shape thereof conforming to the shape of the grooves 102.

For example, when an engineer fits the vanes 200 into the first fitting cavities 110, the vanes 200 slide along the grooves 102 while the vane protrusions 212 remain in surface contact with the grooves 102.

Here, the term "slides" does not indicate that vane protrusions 212 slip on the grooves 102 but indicates that the vane protrusions 212 move inwards of the outer ring segment 100 after coming into surface contact with the grooves 102.

The vanes 200 according to the present embodiment further include a vane recess 220 formed in the root 210 such that the fixing portion 300 is fitted into the vane recess 220 (see FIGS. 4 and 5). The cross-section of the vane recess 220 corresponds to the cross-section of the fixing portion 300.

The vane recess 220 is provided in the path along which the fixing portion 300 is inserted. According to the present embodiment, as illustrated in the drawings, the depth of the vane recess 220 corresponds to ½ of the height h of the fixing portion 300.

The vane recess 220 is butted to or in surface contact with the side surfaces of the fixing portion 300.

The fixing portion 300 according to the present embodiment may be selectively made of a metal material or a nonmetal material. The length of the fixing portion 300 may be equal to or smaller than the length of the outer ring segment 100 such that when an engineer inserts the fixing portion 300 into the second fitting cavities 120 of the outer ring segment 100, the fixing portion 300 can be easily inserted into the second fitting cavities 120.

The cross-sectional area of the fixing portion 300 is smaller than that of the second fitting cavities 120. When fluid passes through the vanes 200, the fixing portion 300 can be thermally expanded by heat energy of the fluid to come into tight contact with the inner portions of the second fitting cavities 120.

In this case, a thermal expansion layer (not shown) may be provided at a predetermined thickness on the outer surface of a major portion of the fixing portion 300 that constitutes the contour of the fixing portion 300. Although the thickness of the thermal expansion layer is not specifically limited, the thickness of the thermal expansion layer is determined to be a predetermined value in consideration of the temperature of the root 210.

Accordingly, when an engineer inserts the fixing portion 300 into the second fitting cavities 120, the fixing portion 300 may be easily inserted since the size of the cross-section of the fixing portion 300 is smaller than the size of the open area of the second fitting cavities 120.

In addition, when fluid passes through the vanes 200, the fixing portion 300 can be thermally expanded to be fitted to the second fitting cavities 120 by an interference fit, and it is thereby prevented from being separated outwards.

A lubricant may be applied to the outer surface of the fixing portion 300 to facilitate the insertion of the fixing portion 300 into the second fitting cavities 120. In this case, a small amount of lubricant may be applied to the fixing portion 300.

According to another embodiment of the present disclosure, a technical configuration including the above-described vane assembly may be applied to a compressor. The vane assembly may be applied to at least one of a gas turbine and a steam turbine. Specific components are the same as the above-described components, and reference numerals thereof will be omitted.

In this regard, the present disclosure provides a compressor including a vane assembly, where the vane assembly includes an outer ring segment surrounding a rotor extending through an inner central portion of a casing, the outer ring segment including first fitting cavities respectively extending in an axial direction of the rotor and second fitting cavities provided within the outer ring segment to be arranged in a circumferential direction of the outer ring segment, vanes fitted into the first fitting cavities, and a fixing portion fitted into the second fixing cavities to fix the vanes to the outer ring segment.

Figure 6:
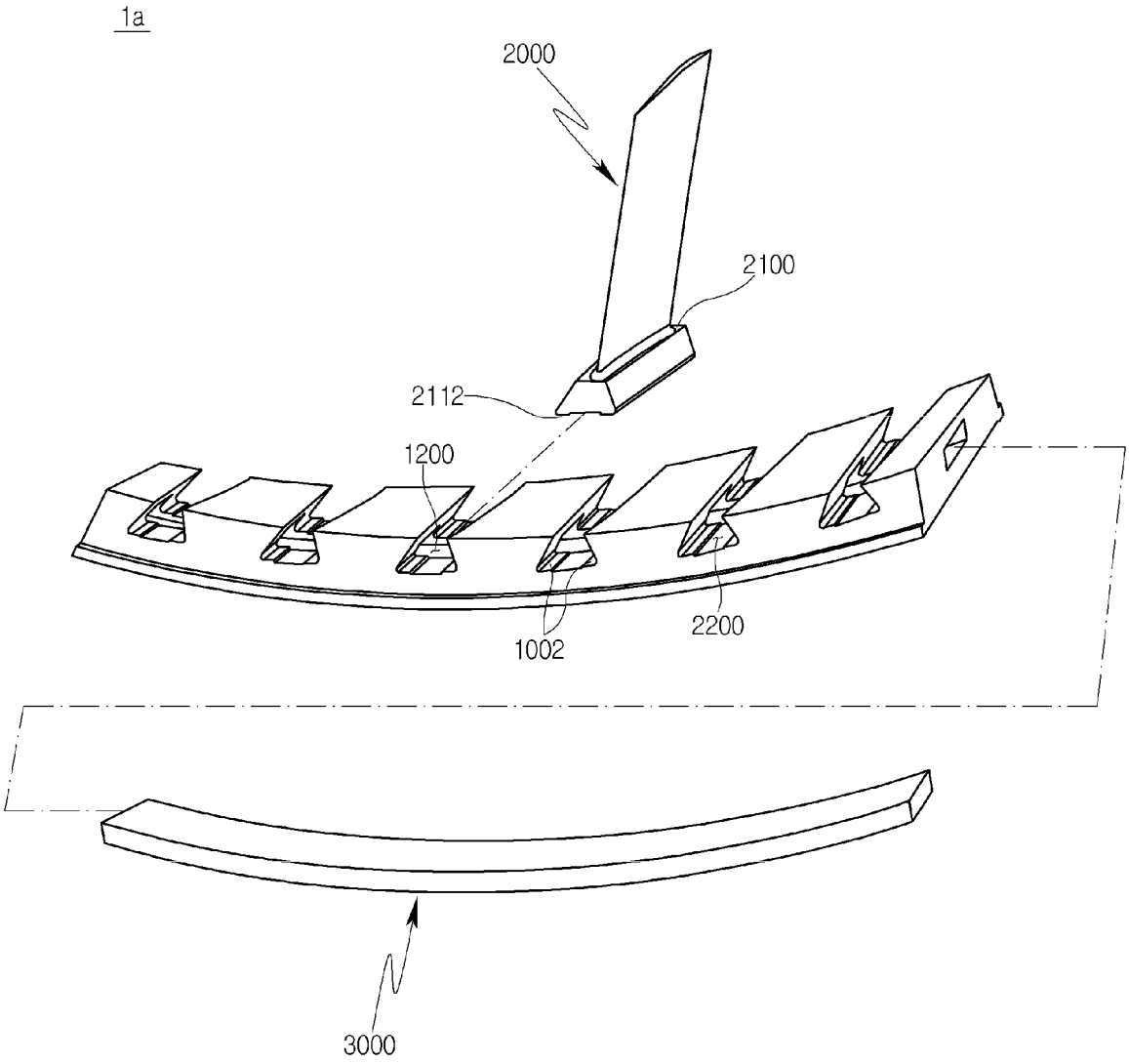
FIG. 6 is an exploded perspective view illustrating a vane assembly according to another embodiment of the present disclosure.
Figure 7:
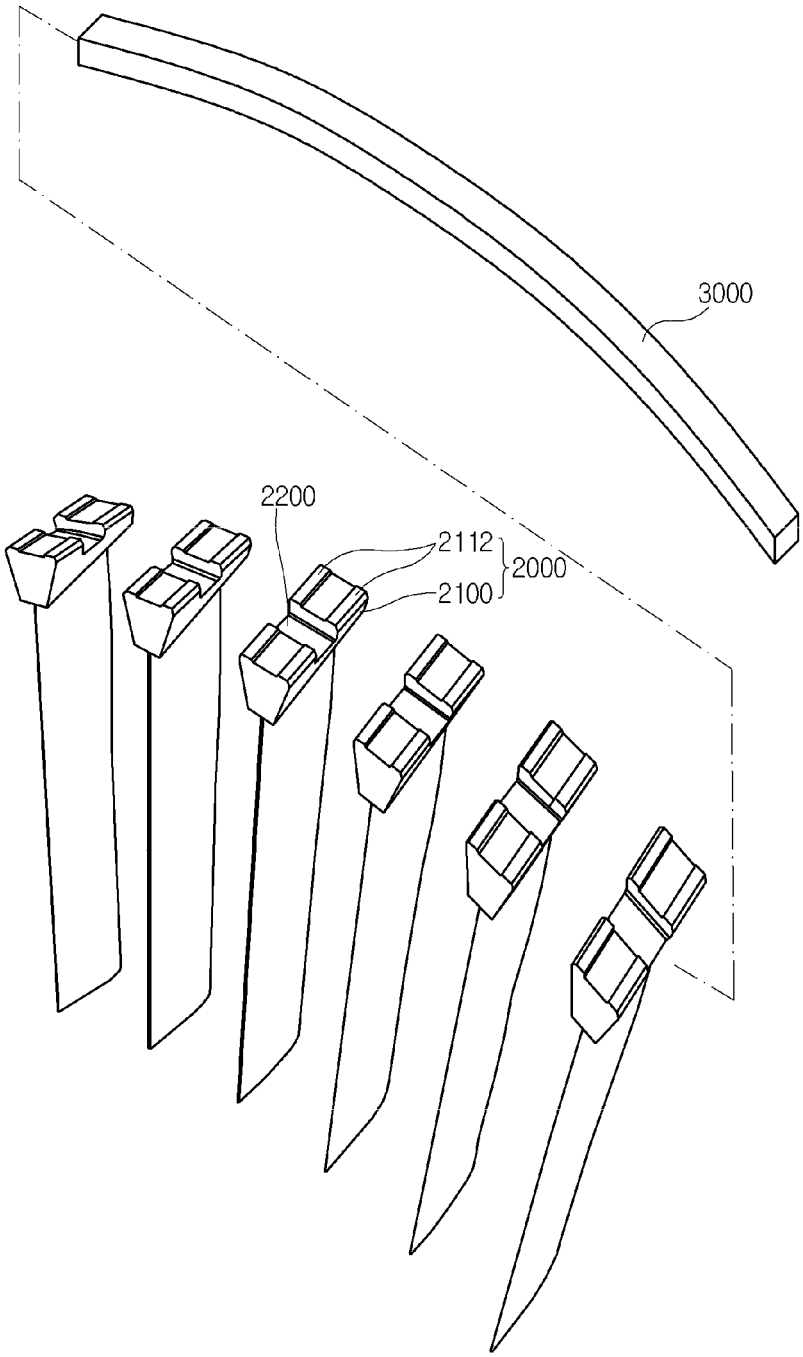
FIGS. 7 and 8 are perspective views illustrating the coupling of the vanes and the fixing portion of the vane assembly according to another embodiment of the present disclosure.
Figure 8:
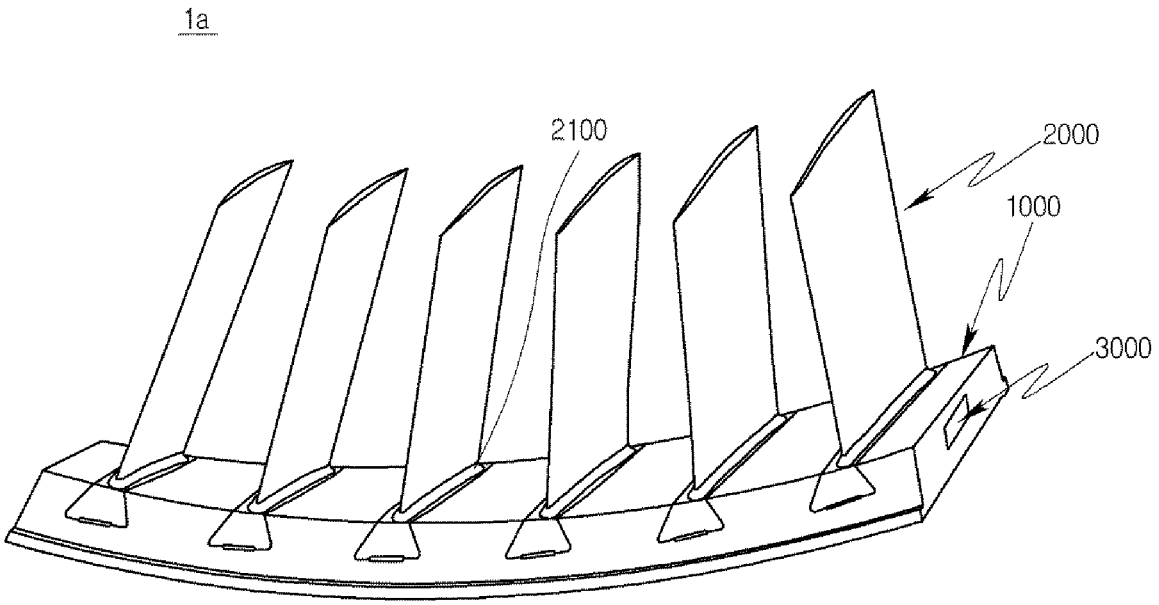
Figure 9:
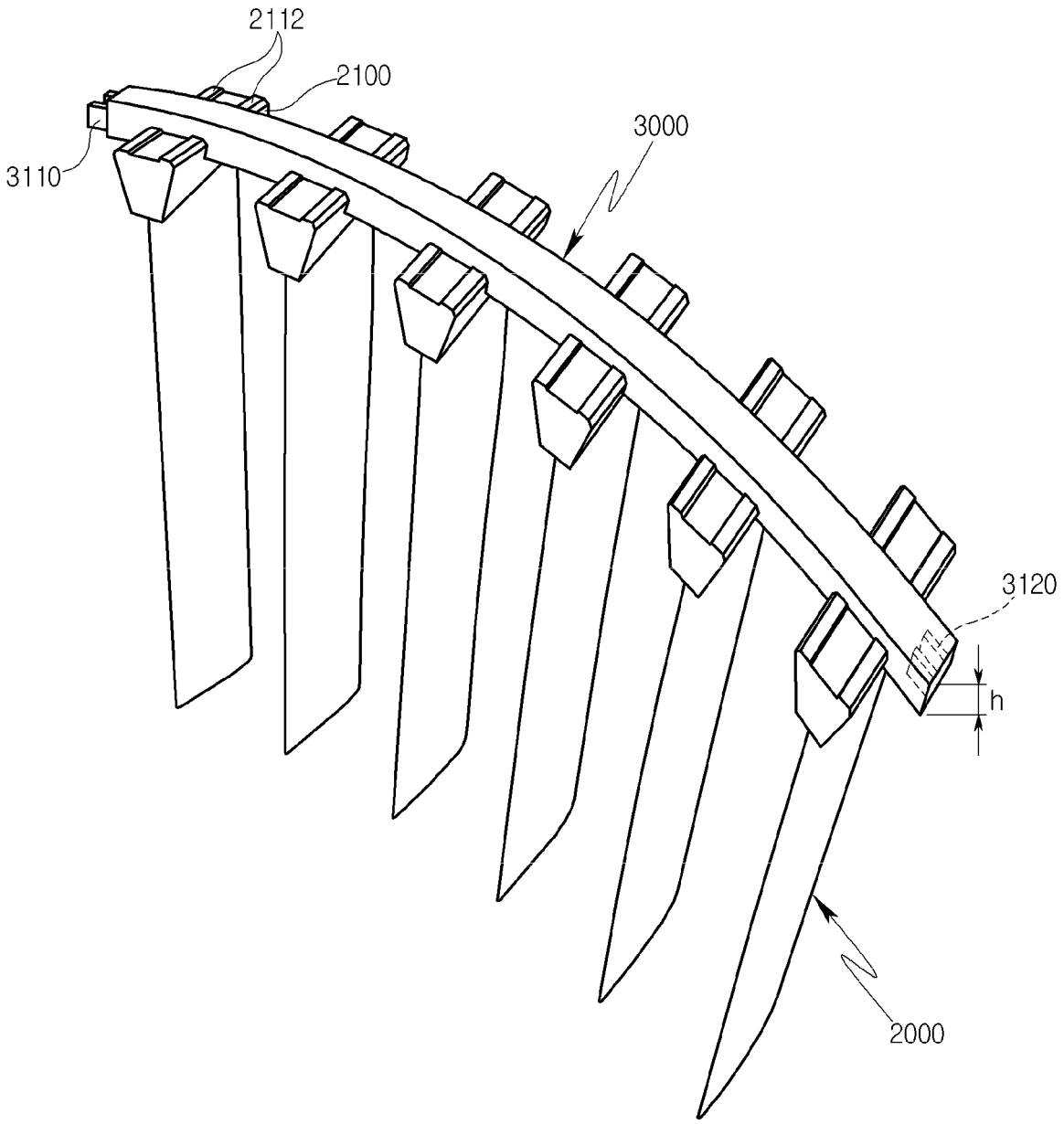
FIG. 9 is a perspective view illustrating the assembled vane assembly according to another embodiment of the present disclosure.

Hereinafter, the compressor including a vane assembly according to another embodiment of the present disclosure will be described with reference to the accompanying drawings. For reference, FIG. 6 is an exploded perspective view illustrating a vane assembly according to another embodiment of the present disclosure, FIGS. 7 and 8 are perspective views illustrating the coupling of the vanes and the fixing portion of the vane assembly according to another embodiment of the present disclosure, and FIG. 9 is a perspective view illustrating the assembled vane assembly according to another embodiment of the present disclosure.

In the description of the present embodiment with reference to FIGS. 6 to 9, the vanes will be described as being disposed in a gas turbine. It should, however, be understood that the vanes can be applied to both a steam turbine and a turbine apparatus.

In addition, according to the present embodiment, a plurality of vanes 2000 are located concentrically around the rotor 20 (see FIG. 1), as illustrated in the drawings. High-pressure fluid moves in the axial direction of the rotor 2 (20) by passing through the vanes 2000. The vanes 2000 guide the movement of fluid, which continuously moves in the axial direction of the rotor 20 after passing through the vanes 200.

The vane assembly 1*a* includes an outer ring segment 1000 surrounding the rotor 20 extending through an inner central portion of the casing 10 provided in the compressor 12 or a compressor section of the gas turbine, the outer ring segment 1000 including first fitting cavities 2200 respectively extending in an axial direction of the rotor 20 and second fitting cavities 1200 provided within the outer ring segment 1000 to be arranged in a circumferential direction of the outer ring segment 1000, vanes 2000 fitted into the first fitting cavities 2200, and a fixing portion 3000 fitted into the second fixing cavities 1200 to fix the vanes 2000 to the outer ring segment 1000.

The outer ring segment 1000 has the shape of an arc extending a predetermined length, and a plurality of outer ring segments 1000 are in tight contact with each other in the circumferential direction, thereby forming a single outer ring. The outer ring segment 1000 has the first fitting cavities 2200 and second fitting cavities 1200. The first fitting cavities 2200 extend in the axial direction of the rotor 2, such that the vanes 2000 are fitted thereinto. The second fitting cavities 1200 are provided in inner portions of the outer ring segment 1000 in the circumferential direction of the outer ring segment 1000.

The shape of the first fitting cavities 2200 is one selected from among a polygon, an ellipse, or a rounded shape, directed radially outward of the rotor 2 or the outer ring segment 1000. According to the present embodiment, the first fitting cavities 2200 are illustrated as a triangular shape since the vanes 2000 are fitted into the first fitting cavities 2200. However, the shape of the first fitting cavities 2200 is not limited thereto but may be altered to other shapes.

In particular, when the first fitting cavities 2200 are of a triangular shape, the vanes 2000 can firmly remain in the fitted positions without being radially separated.

The first fitting cavities 2200 are disposed in the outer ring segment 1000 to be spaced apart from each other at equal distances in the circumferential direction. The vanes 2000 fitted into the first fitting cavities 2200 are disposed on the inner circumferential portions of the outer ring segment 1000, where the vanes 2000 are spaced apart from each other at equal distances.

When the vanes 2000 to be described later are fitted into the first fitting cavities 2200, the vanes 2000 come into tight contact with the first fitting cavities 1100, thereby firmly disposed in the fitted positions.

According to the present embodiment, the first fitting cavities 2200 of the outer ring segment 1000 perpendicularly intersect the second fitting cavities 1200. Since the fixing portion 3000 is inserted into the second fitting cavities 1200 via open portions of the first fitting cavities 2200, the vanes 2000 can be firmly fixed.

The outer ring segment 1000 further includes a plurality of grooves 1002 provided in the first fitting cavities 2200 to extend in the axial direction of the rotor 20. A pair of grooves 1002 is provided on both sides of each of the first fitting cavities 2200 to face each other in the circumferential direction of the outer ring segment 1000. When the vanes 2000 are fitted into the first fitting cavities 2200, the grooves 1002 guide the vanes 2000 to facilitate the insertion thereof.

Since the grooves 1002 are disposed in regions of the first fitting cavities 2200, except for a path along which the fixing portion 3000 is inserted, the vanes 2000 can be firmly fixed to the outer ring segment 1000.

Each of the vanes 2000 includes a root 2100 fitted into a first fitting cavity, among the first fitting cavities 2200, corresponding thereto. The shape of the root 2100 conforms to the shape of the first fitting cavities 2200.

The root 2100 has vane protrusions 2112 protruding toward the first fitting cavities 1100. The vane protrusions 2112 are provided in positions corresponding to the positions of the above-described grooves 1002, with the shape thereof conforming to the shape of the grooves 1002.

For example, when an engineer fits the vane 2000 into the first fitting cavities 2200, the vanes 2000 slide along the grooves 1002 while the vane protrusions 2112 remain in surface contact with the grooves 1002. Here, the term "slides" does not indicate that vane protrusions 2112 slip on the grooves 1002 but indicates that the vane protrusions 2112 move inwards of the outer ring segment 1000 after coming into surface contact with the grooves 1002.

The vanes 2000 according to the present embodiment further include a vane recess 2200 formed in the root 2100 such that the fixing portion 3000 is fitted into the vane recess 2200. The cross-section of the vane recess 2200 corresponds to the cross-section of the fixing portion 3000.

The vane recess 2200 is provided in the path along which the fixing portion 3000 is inserted. According to the present embodiment, as illustrated in the drawings, the depth of the vane recess 2200 corresponds to ½ of the height h of the fixing portion 3000.

The vane recess 2200 is butted to or in surface contact with the side surfaces of the fixing portion 3000.

The vane recess 2200 has the shape of an arc concentric with the rotor 20, and is curved with a curvature corresponding to a curvature of the outer ring segment 1000. Since the curvature of the fixing portion 3000 is equal to the curvature of the outer ring segment 1000, the fixing portion 3000 can be easily inserted into the outer ring segment 1000 when inserted via the vane recesses 2220 without being stopped in any location.

The fixing portion 3000 according to the present embodiment may be selectively made of a metal material or a nonmetal material. The length of the fixing portion 3000 may be smaller than the length of the outer ring segment 1000 such that when an engineer inserts the fixing portion 3000 into the second fitting cavities 1200 of the outer ring segment 1000, the fixing portion 3000 can be easily inserted into the second fitting cavities 1200.

Unlike the foregoing embodiment, the length of the fixing portion 3000 may be different from the length of the outer ring segment 1000 even if the curvatures thereof are the same. Accordingly, an engineer may insert the fixing portion 3000 into the second fitting cavities 1200 more easily.

The cross-sectional area of the fixing portion 3000 is smaller than that of the second fitting cavities 1200. When fluid passes through the vanes 2000, the fixing portion 3000 can be thermally expanded by heat energy of the fluid to come into tight contact with the inner portions of the second fitting cavities 1200.

In this case, a thermal expansion layer (not shown) may be provided at a predetermined thickness on the outer surface of a major portion of the fixing portion 3000 that constitutes the contour of the fixing portion 3000. Although the thickness of the thermal expansion layer is not specifically limited, the thickness of the thermal expansion layer is determined to be a predetermined value in consideration of the temperature of the root 2100.

Accordingly, when an engineer inserts the fixing portion 3000 into the second fitting cavities 1200, the fixing portion 3000 may be easily inserted since the size of the cross-section of the fixing portion 3000 is smaller than the size of the open area of the second fitting cavities 1200.

In addition, when fluid passes through the vanes 2000, the fixing portion 3000 can be thermally expanded to be fitted to the second fitting cavities 1200 by an interference fit, and it is thereby prevented from being separated outwards.

A lubricant may be applied to the outer surface of the fixing portion 3000 to facilitate the insertion of the fixing portion 3000 into the second fitting cavities 1200. In this case, a small amount of lubricant may be applied to the fixing portion 3000.

Hereinafter, another exemplary fixing portion provided in the vane assembly according to an embodiment of the present disclosure will be described with reference to the accompanying drawings.

Figure 10:
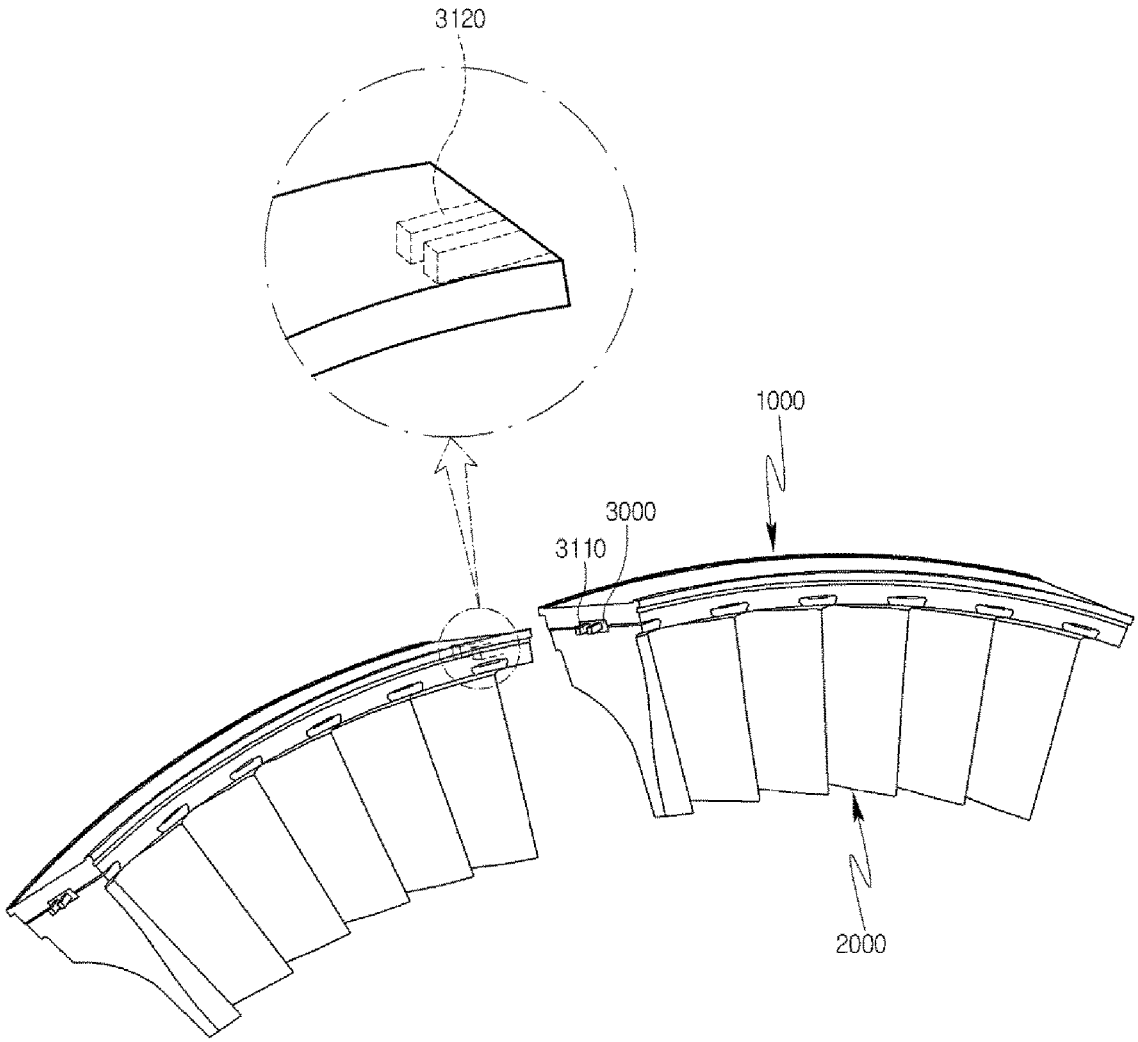
FIGS. 10 to 12 are perspective views illustrating another exemplary fixing portion provided in the vane assembly according to an embodiment of the present disclosure.
Figure 11:
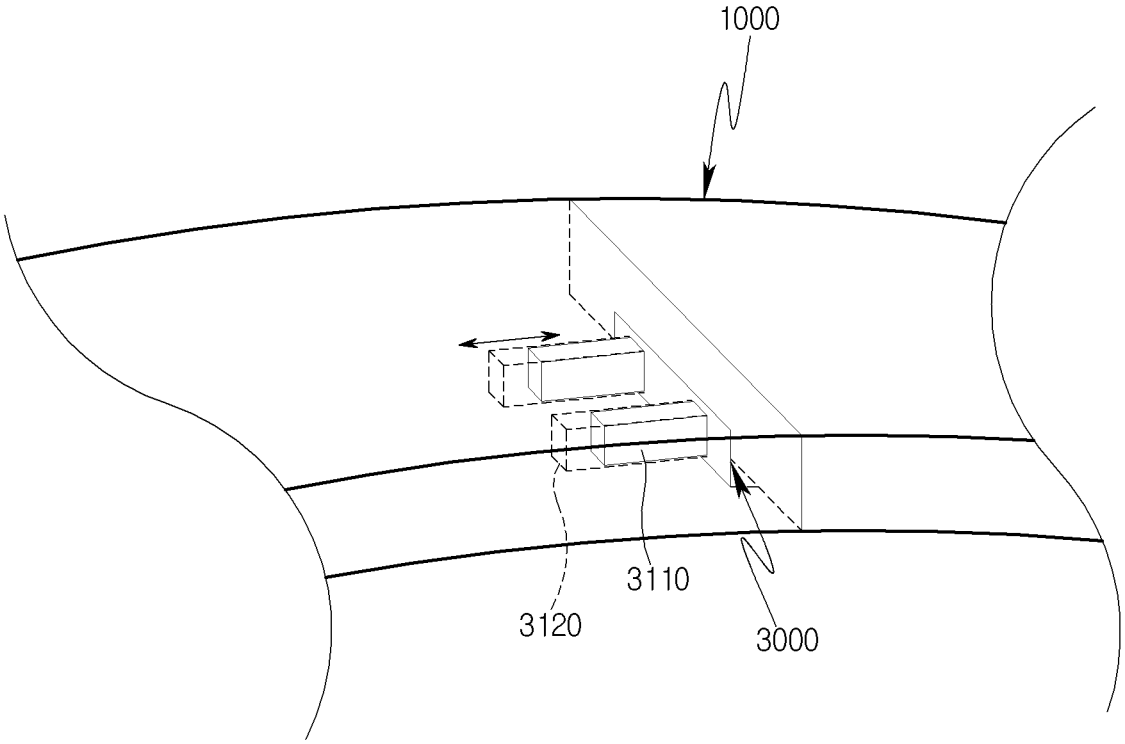
Figure 12:
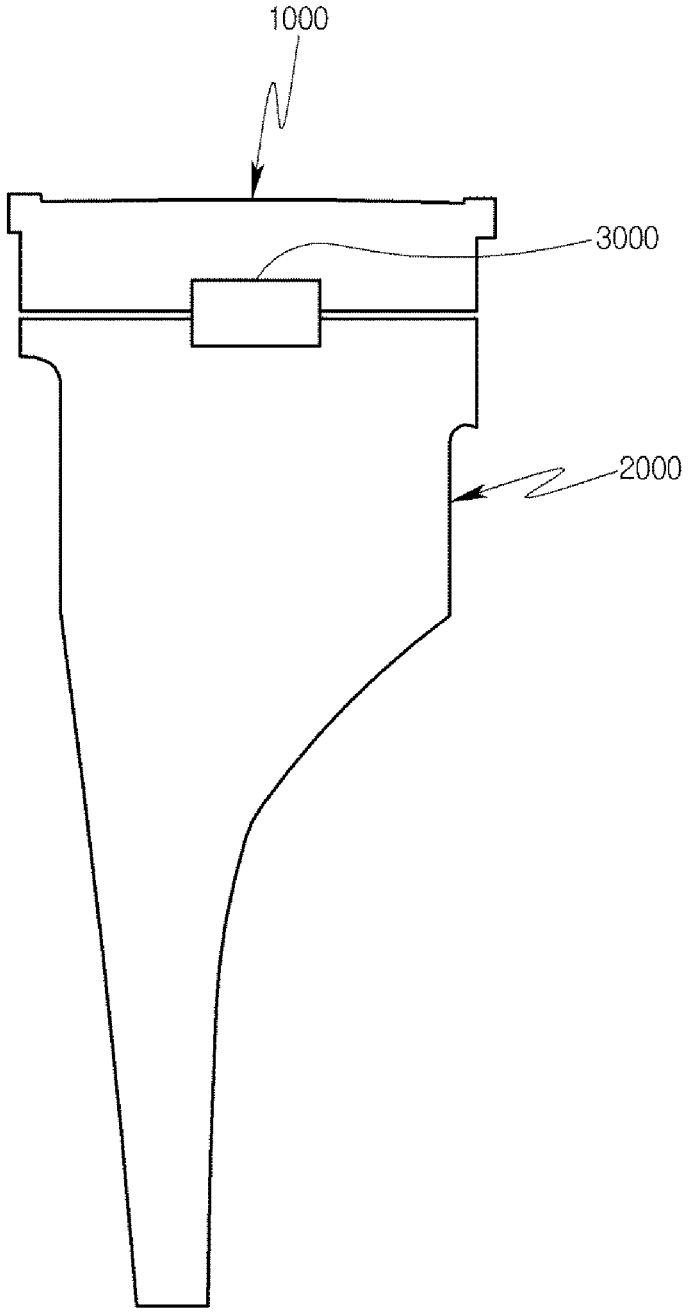

Referring to FIGS. 10 to 12, the fixing portion 3000 includes lugs 3110 protruding outwards from the leading end of the fixing portion 3000, in the direction in which the fixing portion 3000 is inserted into the second fitting cavities 1200 of the outer ring segment 1000, and receptacles 3120 recessed into the rear end of the fixing portion 3000.

When a plurality of fixing portions 3000 are inserted into the second fitting cavities 1200 of a plurality of outer ring segments 1000, the fixing portions 3000 can be coupled to each other after being inserted into the outer ring segments 1000 in order to improve fixing force.

In this regard, according to the present disclosure, the lugs 3110 are provided on the leading end of the fixing portion 3000, and the receptacles 3120 are provided in the rear end of the fixing portion 3000. Since the lugs 3110 are fitted into the receptacles 3120 provided in the adjacent fixing portion, the plurality of fixing portions 300 are fixedly coupled together.

This may help to maintain the coupling force between the fixing portions 300 even in the case in which the compressor vibrates.

The shape of the lugs 3110 is not limited to the shape illustrated in the drawings and may be altered to other shapes. Although the lugs 3110 are illustrated as protruding in the shape of plates, the lugs 3110 may have any other shapes that can be easily coupled to the receptacles 3120.

The shape of the receptacles 3120 conforms to the shape of the lugs 3110 and may be altered to other shapes instead of the recesses.

When the fixing portions 3000 according to the present embodiment is disposed in a compressor, the length of the lugs 3110 may be varied depending on the ambient temperature.

Referring to FIG. 10, more specifically, the lugs 3110, configured to be fitted into the receptacles 3120, extend in a lesser degree than that of the receptacles 3120. Specifically, the lengths of the lugs 3110 are determined in consideration of a length by which the lugs 3110 extend in the longitudinal direction of the fixing portion 3000 when the lugs 3110 are thermally expanded.

In this case, since the lugs 3110 are thermally expanded toward the front in a reversible manner, depending on the temperature conditions of locations of the vane assembly 1*a*, the fixability of vanes 2000 coupled to the outer ring is improved.

A plurality of vane assemblies 1*a* according to the present embodiment may be disposed in the entirety of stages, including a first stage to the last stage, of the compressor 12 of the gas turbine. The vane assembly 1*a* guides the direction of the movement of air supplied by the compressor 12 from an external source so that the air is supplied to the combustor 11.

The compressor 12 includes ten or more stages, including a first stage to the last stage. Since the vane assembly 1*a* guides the movement of high-pressure fluid, the occurrence of a minimum amount of shaking or vibration may be advantageous.

According to the present disclosure, even in the case in which the vane assemblies 1*a* are disposed in the entirety of the compressor 12, the vanes 2000 can firmly remain in positions fitted into the first fitting cavities 110 without shaking, thereby minimizing unnecessary vibration.

The vane assemblies 1*a* according to the present disclosure may be disposed in the $(n+1)^{th}$ stage to the last stage of the compressor of the gas turbine, except for the first stage to the $n^{th}$ stage. Variable vanes are disposed in the first stage to the $n^{th}$ stage, in which no vane assemblies 1*a* are disposed. The variable vanes can improve the efficiency of compression of the compressor, since the angles thereof can be varied in the axial direction of the rotor 20 by separate actuators (not shown).

In this case, the vane assemblies 1*a* are not disposed in any of the first stage to the third stage, but are disposed in the fourth stage to the last stage. This can consequently improve the efficiency of the gas turbine and extend the range of operation.

The fixing portion 3000 is made of a metal material or a nonmetal material having a low coefficient of friction. When the fixing portion 3000 is inserted into the second fitting cavities 2200, friction may occur. Specifically, friction between the inner surfaces of the second fitting cavities 1200 and the fixing portion 3000 may prevent the fixing portion 3000 from being easily inserted. However, the fixing portion 3000, made of a low-friction material according to the present embodiment, can be easily inserted into the second fitting cavities 1200 by an engineer, thereby improving workability.

In particular, according to the present embodiment, when the engineer fixes the vanes 2000 by inserting the fixing portion 3000 in the radial direction of the outer ring segment 1000, both the vanes 2000 and the outer ring segment 1000 can be fixed using the fixing portion 3000. Consequently, a plurality of vanes 2000 can be fixed at the same time.

Although the exemplary embodiments of the present disclosure have been described for illustrative purposes, a person skilled in the could make various modifications and variations by adding, changing, removing, or substituting for the elements without departing from the principle of the present disclosure. It should be understood that all such modifications and variations are included within the scope of the present disclosure.

What is claimed is:

1. A vane assembly comprising:

an outer ring segment surrounding a rotor extending through an inner central portion of a casing;

vanes fitted into the outer ring segment in a direction perpendicular to an axial direction of the rotor; and a fixing portion fitted into the outer ring segment to fix the vanes to the outer ring segment, wherein the outer ring segment comprises first fitting cavities respectively extending in the axial direction of the rotor and second fitting cavities provided within the outer ring segment to be arranged in a circumferential direction of the outer ring segment, the vanes are fitted into the first fitting cavities, and the fixing portion is fitted into the second fitting cavities, the second fitting cavities perpendicularly intersect the first fitting cavities, and the outer ring segment comprises an arc-shaped outer ring segment extending a predetermined length, and wherein the vanes comprise roots fitted into the first fitting cavities, the roots having a shape conforming to a shape of the first fitting cavities, and vane recesses provided in the roots such that the fixing portion is fitted into the vane recesses, the vane recesses having a cross-section corresponding to a cross-section of the fixing portion, and a length of the fixing portion is shorter than a length of the outer ring segment.

2. The vane assembly according to claim 1, wherein the first fitting cavities have a shape selected from the group consisting of a polygon, an ellipse, and a rounded shape, directed radially outward of the rotor or the outer ring segment.

3. The vane assembly according to claim 1, wherein the outer ring segment further comprises a plurality of protrusions provided in the first fitting cavities to protrude in the axial direction of the rotor.

4. The vane assembly according to claim 3, wherein a pair of protrusions among the plurality of protrusions is provided on both sides of a corresponding fitting cavity among the plurality of fitting cavities to face each other in the circumferential direction of the outer ring segment.

5. The vane assembly according to claim 1, wherein the roots comprise vane protrusions protruding toward the first fitting cavities.

6. A gas turbine comprising a vane assembly, wherein the vane assembly comprises:

an outer ring segment surrounding a rotor extending through an inner central portion of a casing provided in a compressor of the gas turbine, the outer ring segment comprising first fitting cavities respectively extending in an axial direction of the rotor and second fitting cavities provided within the outer ring segment to be arranged in a circumferential direction of the outer ring segment;

vanes fitted into the first fitting cavities; and a fixing portion fitted into the second fixing cavities to fix the vanes to the outer ring segment, wherein the fixing portion comprises:

a lug protruding outwards from a leading end of the fixing portion, in a direction in which the fixing portion is inserted into the second fitting cavities of the outer ring segment; and a receptacle recessed into a rear end of the fixing portion.

7. The gas turbine according to claim 6, wherein the fixing portion has a curvature the same as a curvature of the outer ring segment.

8. The gas turbine according to claim 6, wherein the vanes comprise roots fitted into the first fitting cavities, the roots having a shape conforming to a shape of the first fitting cavities.

9. The gas turbine according to claim 8, wherein the vanes further comprise vane recesses provided in the roots such that the fixing portion is fitted into the vane recesses, the vane recesses having a cross-section corresponding to a cross-section of the fixing portion.

10. The gas turbine according to claim 9, wherein the vane recesses are concentric with the rotor and are curved with a curvature corresponding to a segment of the outer ring segment.

11. The gas turbine according to claim 8, wherein the roots comprise vane protrusions protruding toward the first fitting cavities.

12. The gas turbine according to claim 6, wherein the second fitting cavities of the outer ring segment perpendicularly intersect the first fitting cavities of the outer ring segment.

13. The gas turbine according to claim 6, wherein the first fitting cavities have a shape selected from the group consisting of a polygon, an ellipse, and a rounded shape, directed radially outward of the rotor or the outer ring segment.

14. The gas turbine according to claim 6, wherein the outer ring segment further comprises a plurality of protrusions provided in the first fitting cavities to protrude in the axial direction of the rotor.

15. The gas turbine according to claim 14, wherein a pair of protrusions among the plurality of protrusions is provided on both sides of a corresponding fitting cavity among the plurality of fitting cavities to face each other in the circumferential direction of the outer ring segment.

16. The gas turbine according to claim 14, wherein the protrusions are located in regions except for a path along which the fixing portion is inserted.

* * * * *